US005974741A

United States Patent [19]

Fukuhara

[11] Patent Number: 5,974,741

[45] Date of Patent: Nov. 2, 1999

[54] MANHOLE COVER RECEIVING FRAME

[75] Inventor: Masaru Fukuhara, Kawaguchi, Japan

[73] Assignee: Fukuhara Cast Iron Inc., Tokyo, Japan

[21] Appl. No.: 08/934,614

[22] Filed: Sep. 22, 1997

[30] Foreign Application Priority Data

Sep. 25, 1996 [JP] Japan ..... 8-287215
Dec. 2, 1996 [JP] Japan ..... 8-354222

[51] Int. Cl.[6] ..... E02D 29/14

[52] U.S. Cl. ..... 52/20; 52/19; 404/25; 404/26

[58] Field of Search ..... 52/19, 20; 404/25, 404/26

[56] References Cited

U.S. PATENT DOCUMENTS

| | | | |
|---|---|---|---|
| 3,858,998 | 1/1975 | Larsson et al. | 52/19 X |
| 4,582,450 | 4/1986 | Neil | 52/20 X |
| 4,906,128 | 3/1990 | Trudel | 404/26 |
| 4,925,337 | 5/1990 | Spiess et al. | 404/26 |
| 5,205,668 | 4/1993 | Adams | 404/26 |
| 5,513,926 | 5/1996 | Prescott | 404/26 |

*Primary Examiner*—Carl D. Friedman
*Assistant Examiner*—Timothy B. Kang
*Attorney, Agent, or Firm*—Wenderoth, Lind & Ponack, L.L.P.

[57] ABSTRACT

A manhole cover receiving frame includes an outer tube and a cover receiving frame. The cover receiving frame may be axially moved relative to the outer tube so that an upper surface of the manhole cover receiving frame matches the level of the surrounding road surface. The cover receiving frame is moved by a plurality of bolts threaded in the outer tube.

8 Claims, 8 Drawing Sheets

MANHOLE COVER RECEIVING FRAME

BACKGROUND OF THE INVENTION AND PRIOR ART

The present invention relates to a manhole cover receiving frame for underground structures such as manholes for water supply and sewage systems, and manhole structures for fire hydrants, etc.

A conventional underground structure, for example, a cover receiving frame of a manhole for water supply and sewage systems is provided in a manhole tube. Therefore, when the road surface is not level with the upper surface of the manhole cover receiving frame, a level adjusting ring must be inserted between the manhole tube and the manhole cover receiving frame or a ring must be removed therefrom. However, this operation is not only cumbersome but also is time consuming.

In the case where the level of the manhole cover receiving frame must be adjusted to match the level of the surrounding road surface, the traffic must first be stopped, after which the following tasks must be are carried out sequentially:

(A) cutting an existing pavement (B) lowering the existing pavement (C) digging operation (D) removal of a cover receiving frame (E) installation of an adjusting ring (F) installation of a cover receiving frame (G) adjustment of the level of roadbed (H) transfer of the pressure of roadbed (I) temporary pavement (J) final pavement These tasks are troublesome and are time consuming, thus increasing costs.

So, with roads having heavy traffic, a traffic jam is created due to the level adjustment work. Development of a method for simply finishing the level adjustment work has been desired.

Further, it takes a large amount of time to adjust an angle of inclination for matching the upper surface of the manhole cover with the inclination of the road surface. Therefore, development of measures capable of carrying out the adjusting operation in a short period of time have been desired.

SUMMARY OF THE INVENTION

It is an object of the present invention to provide a manhole cover receiving frame in which the level adjusting operation can be carried out easily, the area around the manhole cover receiving frame need not be disturbed as much as with the prior art, the level adjusting operation can be finished in a short period of time, and adjusting an angle of inclination of a manhole cover can be carried out easily.

The present invention has been accomplished in order to achieve the aforementioned objects. According to a first embodiment, an outer tube and a cover receiving frame which moves up and down therein constitutes a manhole cover receiving frame. The cover receiving frame is moved up and down by a suitable number of bolts threaded in the outer tube.

That is, in the first embodiment, a cover receiving frame, provided with through-holes into which the bolts are inserted, is mounted vertically movably in the outer tube. The outer tube is provided at an internal lower part thereof with a receiving seat and a mounting portion. The mounting portion has a suitable number of bolts threaded therein.

Upper portions of the bolts, inserted into the through-holes, are stopped by a stopper so that even when the bolts are rotated, the bolts are not moved axially with respect to the cover receiving frame.

According to a second embodiment, a device is made to facilitate mounting and assembly of the bolts, in which an internal lower part of the device is provided with a receiving seat. In addition, the device has an outer tube provided with a suitable number of non-threaded holes for receiving the bolts. Nuts are inserted into lateral hole receiving portions of the outer tube. A cover receiving body having an outside diameter is internally provided on the receiving seat within the outer tube. The outer diameter of the outer tube is smaller than an inside diameter of an upper edge of the outer tube. The cover receiving body is provided with fork-like head engaging portions at suitable positions internally thereof. The bolts are provided threaded in the nuts and extend through the head engaging portions and through the non-threaded holes. The stoppers are, in turn, engaged with the lower surface of the head engaging portions.

According to a third embodiment, there is provided a cover receiving frame which is nicely stabilized after it is adjusted to an inclination of the road surface. This embodiment provides a manhole cover receiving frame in which a cover receiving frame body having an outside diameter smaller than an inside diameter of an upper edge of an outer tube is internally provided in the outer tube. The outer tube is provided with a receiving seat at an internal lower part thereof. The cover receiving frame body is moved up and down by bolts provided on the receiving seat. Two spacers have non-parallel top and bottom surfaces or, in other words, two variable slope spacers, in contact with one another at curved surfaces or spherical joining portion are arranged between the receiving frame body and the receiving seat.

According to a fourth embodiment, a scale showing an adjusted height is provided on the outer surface of the cover receiving frame body in order to facilitate the level adjusting operation of the cover receiving frame body.

DETAILED DESCRIPTION OF THE INVENTION

FIRST EMBODIMENT

Figure 1:
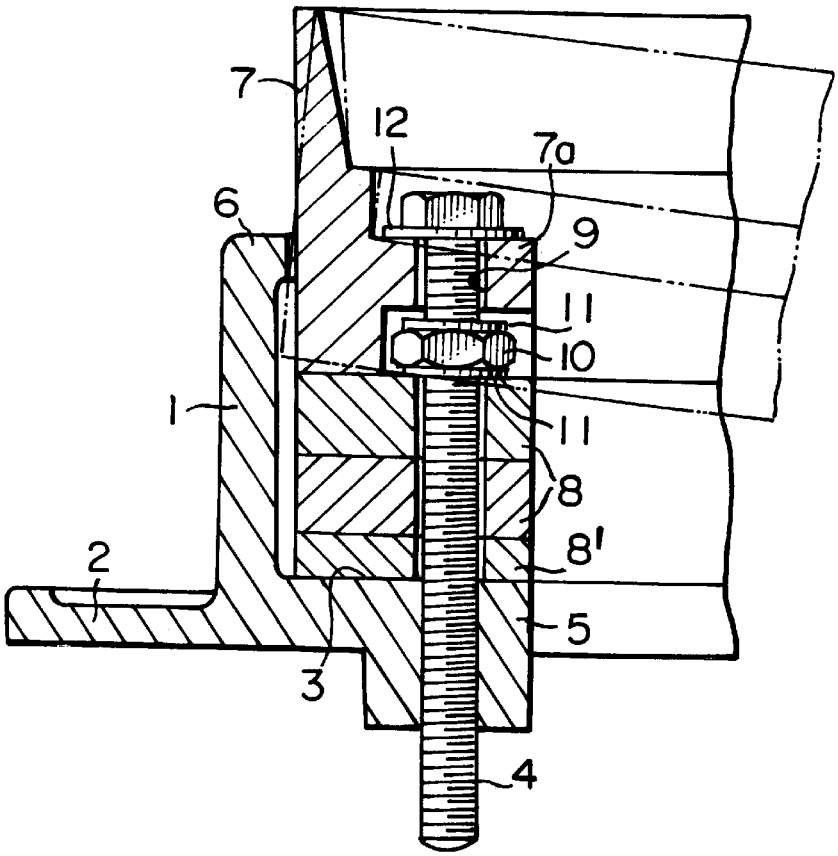
FIG. 1 is an enlarged sectional view of a first embodiment according to the present invention.
Figure 2:
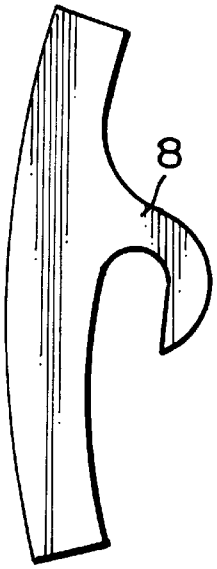
FIG. 2 is a plan view of a level adjusting spacer of the first embodiment according to the present invention.

FIG. 1 shows a first embodiment of the present invention. Reference numeral 1 designates an outer tube in which a flange 2 for positioning the invention is provided externally thereof. Further, a receiving seat 3 and a bolt mounting portion 5 having bolts 4 threaded at three locations are provided at an inner lower part of the outer tube. The outer tube also has an upper edge 6 which is projected inward. Reference numeral 7 designates a cover receiving frame internally provided on the receiving seat 3 within the outer tube 1. The cover receiving frame has an outside diameter slightly smaller than an inside diameter of the upper edge 6 of the outer tube 1. Reference numerals 8, 8' designate level adjusting spacers inserted between the receiving seat 3 of the outer tube 1 and the cover receiving frame 7. The level adjusting spacers have a shape as shown in FIG. 2.

The first embodiment has a constitution in which the bolt 4 is inserted into a non-threaded hole 9 provided in a projection 7*a* of the cover receiving frame 7. The bolt 4 is threaded through the bolt mounting portion 5. A stopper or nut 10 is stopped by stop rings 11 so that the former may not move on bolt 4. A clearance is formed between the bolt mounting portion 5 and the stopper 10 so that the cover receiving frame 7 can be inclined as shown by the imaginary lines. The bolt 4 is rotated so that the cover receiving frame 7 is moved up and down within the outer tube 1.

Next, the procedure for the level adjusting operation for the manhole cover receiving frame and the operation for adjusting an angle of inclination of a manhole cover (not shown) will be explained.

First, the procedure for the level adjusting operation will be explained. In the case of raising the level, the bolts 4 provided at the three positions are rotated to raise the upper surface of the cover receiving frame 7 to coincide with the road surface. Then, an adjusting spacer having a desired height or thickness is inserted into a gap formed below the lower surface of the cover receiving frame 7.

Several spacers different in thickness and spacers without taper as well as tapered spacers, similar to conventional spacers, are prepared for selective use. After insertion of the spacer or spacers, the bolts 4 are tightened to fasten the cover receiving frame 7.

On the other hand, in the case of lowering the level, the bolts 4 are rotated to raise the cover receiving frame 7. After this, the adjusting spacer or spacers 8, 8' is/are removed. Then, the bolts are tightened to lower the cover receiving frame 7. When the cover receiving frame 7 coincides with the road surface, an adjusting spacer or spacers having a desired thickness is/are inserted below the cover receiving frame 7, and the bolts 4 are tightened to fasten the cover receiving frame 7.

With the prior art devices, it had been necessary to remove portions of the adjacent asphalt road surface before performing the level adjusting bulk-up operation. However, in the present invention, such action is not necessary. The cover receiving frame 7 can be simply moved up and down by rotating the bolts 4. Work is completed by a simple operation in which a calking material is filled in a clearance formed between the cover receiving frame 7 and the asphalt road surface. Work can be finished in a short period of time, for example, scores of minutes or a few hours.

With the above embodiment, the nut 10 is used as a stopper, upper and lower portions of which are held fast by the stop rings 11. It is also to be noted that the nut 10 may be replaced with a stop pin such as a split pin.

Next, the procedure for adjusting an angle of inclination will be explained. This procedure is similar to the level adjustment described above. The bolts 4 may be manipulated so that the upper surface of the cover receiving frame 7, that is the upper surface of the manhole cover, coincides with the inclination of the road surface.

According to the present embodiment, in the case of a normal 650 mm manhole, assuming that the height of the outer tube is 110 mm, that the gap between the upper edge 6 of the outer tube 1 and the cover receiving frame 7 is 8 mm, and that the gap between the inner surface of the body of the outer tube 1 and the outer peripheral surface of the cover receiving frame 7 is 3 mm, then, the inclination can be changed from 0° to about 5°. It is also noted that the angle of inclination can be inclined more than that of the above noted angle by increasing the gap.

SECOND EMBODIMENT

Figure 3:
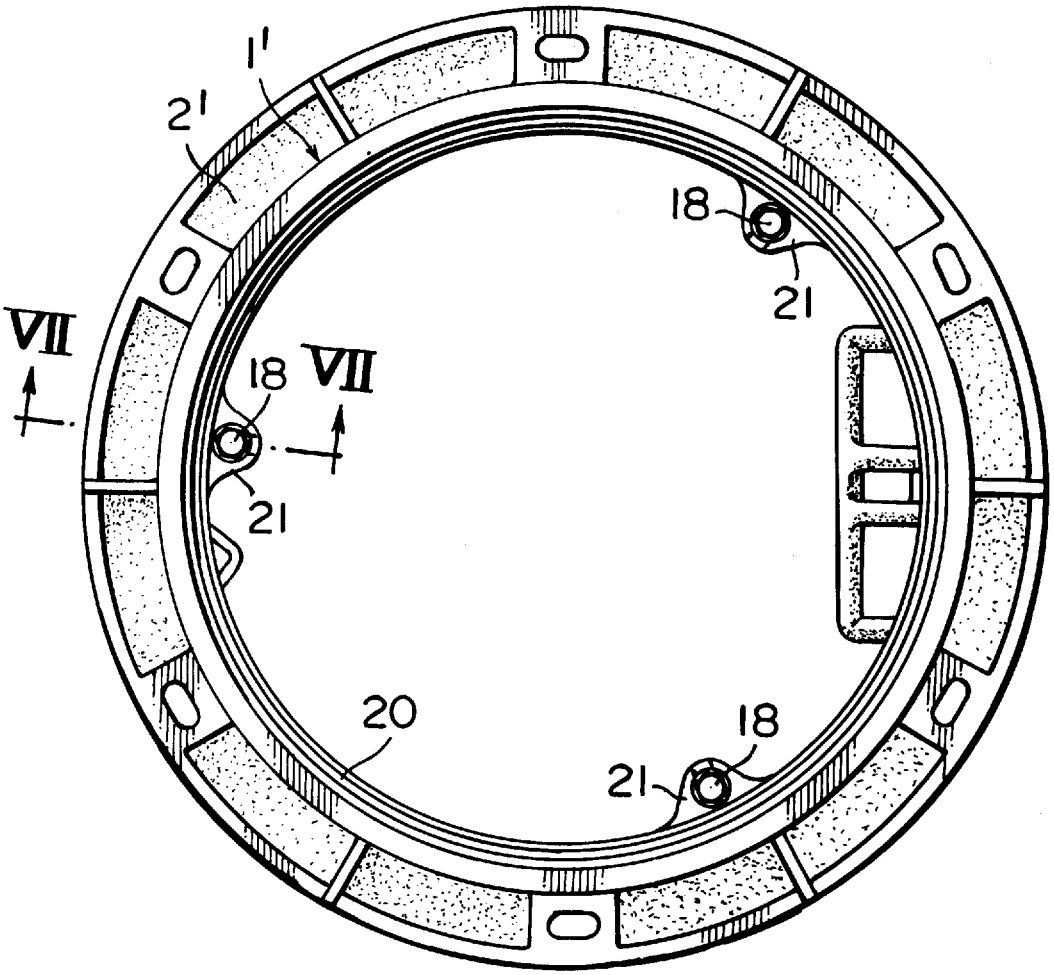
FIG. 3 is a plan view of a second embodiment according to the present invention.
Figure 4:
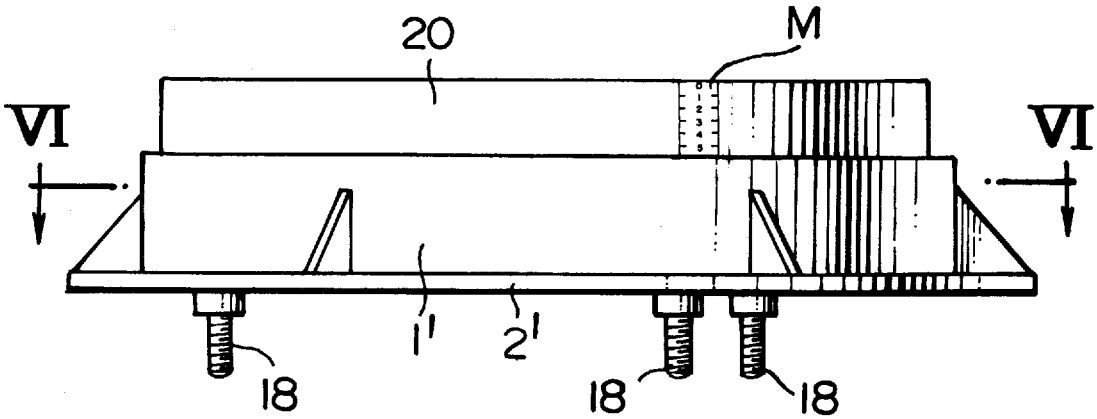
FIG. 4 is a front view of the second embodiment according to the present invention.
Figure 5:
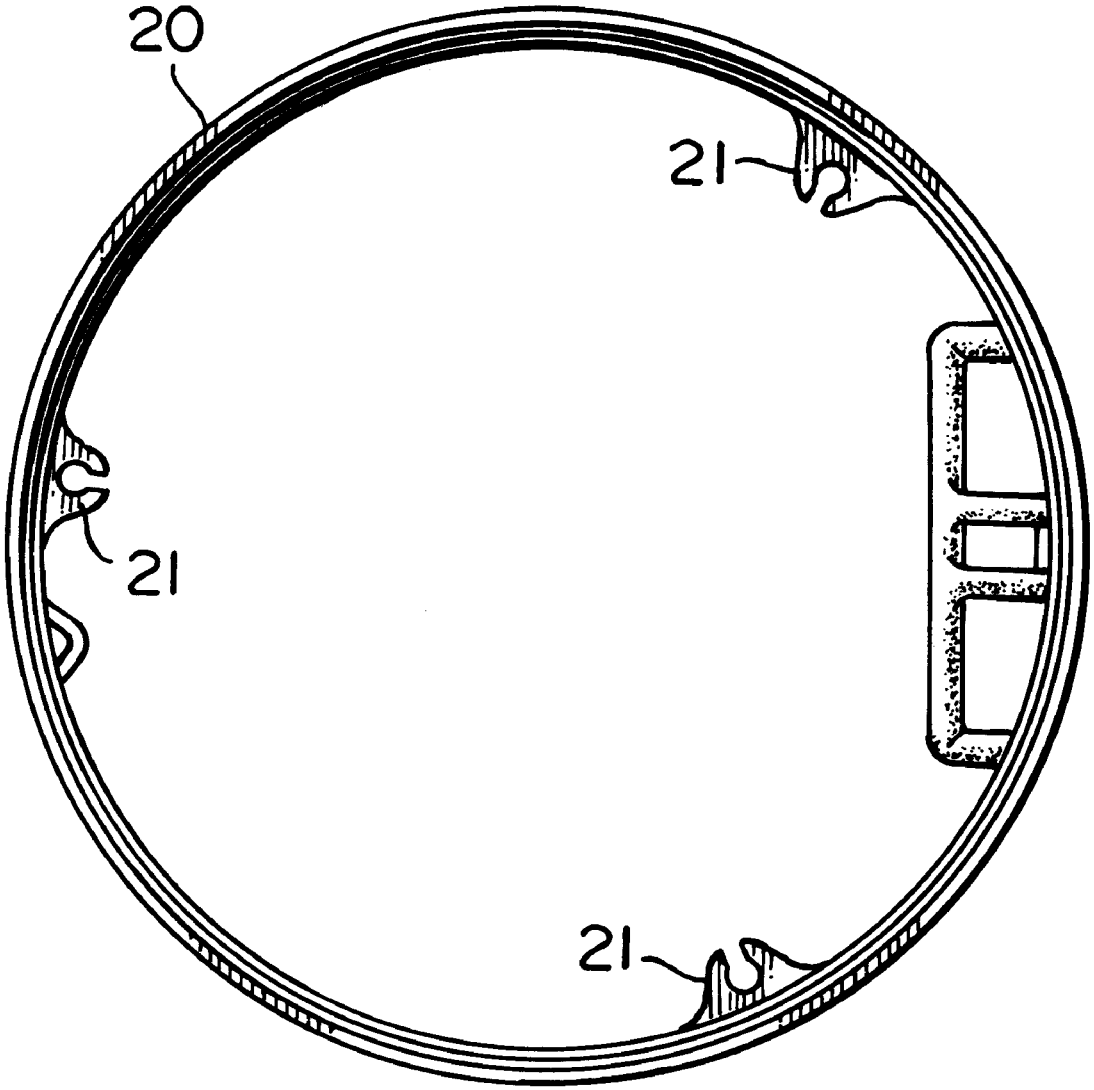
FIG. 5 is a plan view of a cover receiving frame of the second embodiment according to the present invention.
Figure 6:
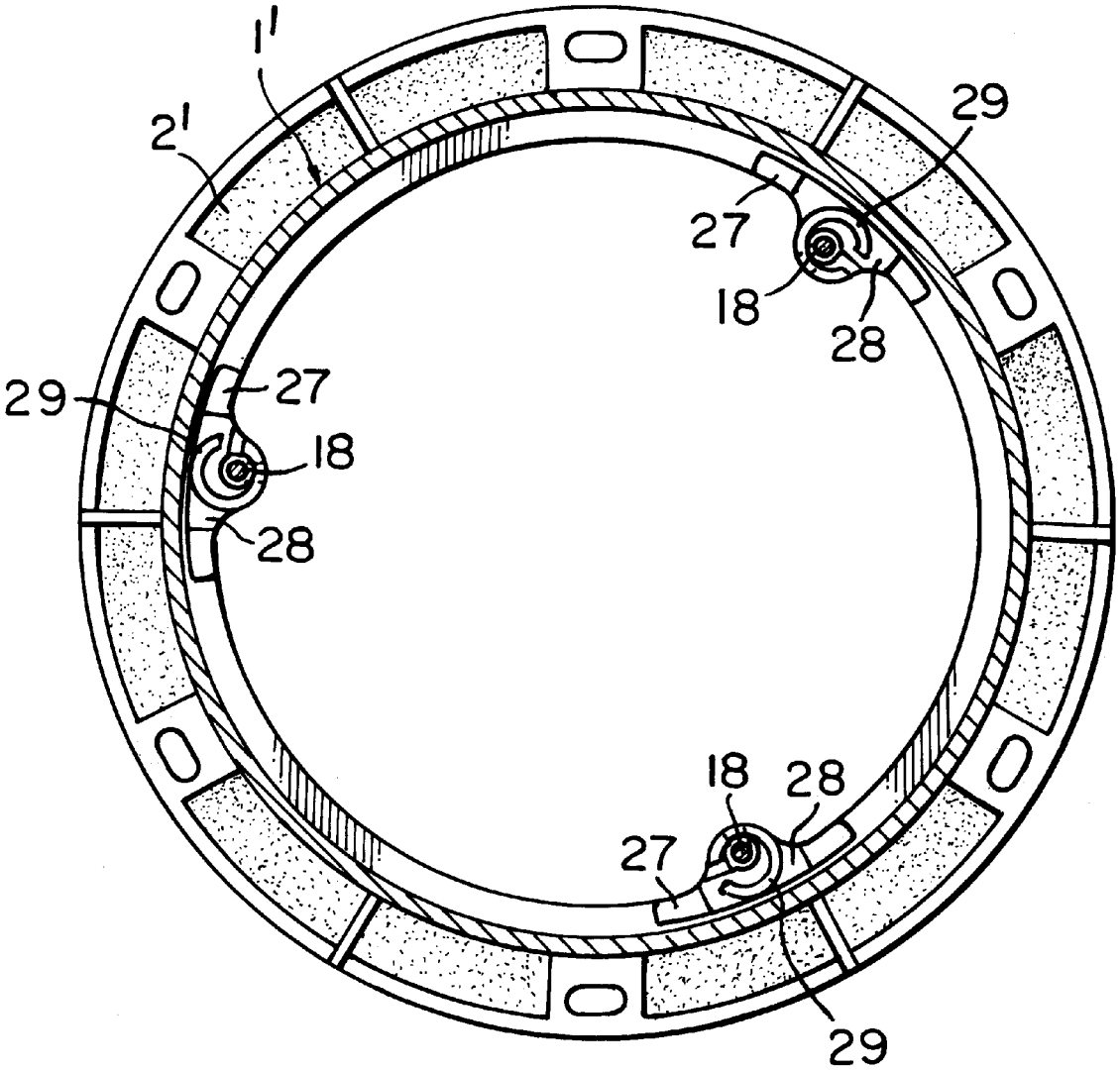
FIG. 6 is a sectional view taken on line VI—VI of FIG. 4.
Figure 7:
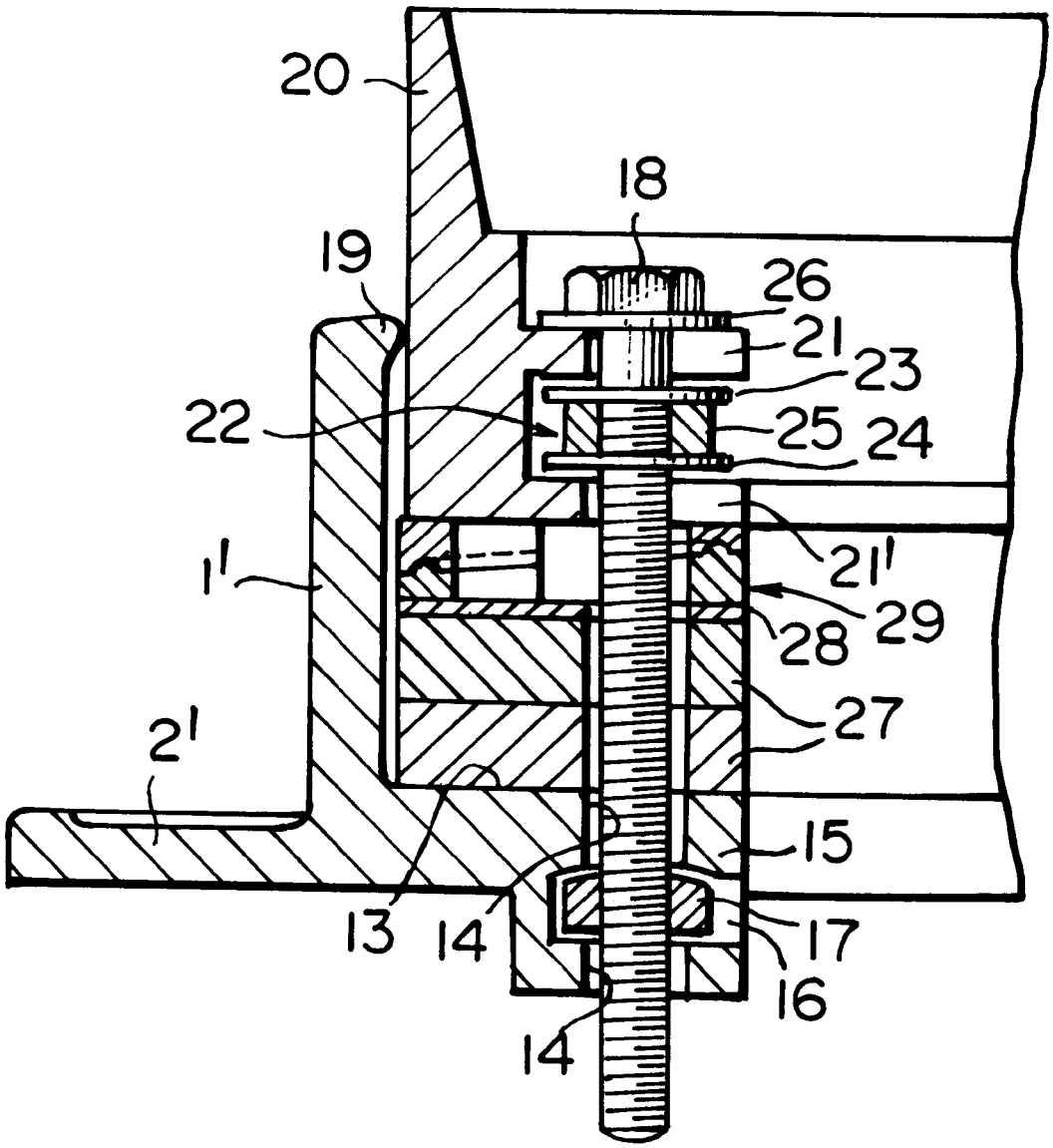
FIG. 7 is an enlarged sectional view taken on line VII—VII of FIG. 3.

FIG. 3 is a plan view of a second embodiment and FIG. 4 is a front view thereof. FIG. 5 is a plan view of a cover receiving frame and FIG. 6 is a sectional view taken on line VI—VI of FIG. 4. FIG. 7 is an enlarged sectional view taken on line VII—VII of FIG. 3. Reference numeral 1' designates an outer tube. Reference number 20 designates a cover receiving frame.

The outer tube 1' is constituted such that a flange 2' for positioning the tube is provided externally thereof. Further, a receiving seat 13 and a bolt mounting portion 15 provided with non-threaded holes 14 at three locations are provided at an inner lower part of the outer tube 1'. Bolts 18 are threaded to nuts 17 inserted into lateral hole receiving portions 16 through the non-threaded holes 14. An upper edge 19 of the outer tube 1' is projected inward, and scales M indicating the adjusted height are located at three positions around an outer surface of the outer tube 1'.

Cover receiving frame 20 is internally provided on the receiving seat 13 within the outer tube 1'. The cover receiving frame has an outer diameter slightly smaller than an inside diameter of an upper edge 19 of the outer tube 1'. Fork-like head engaging portions 21 in engagement with the bolts 18 at the three positions and a base portion 21' are provided as shown in FIG. 7. The base portion 21' is not always necessary in terms of function, and may be omitted.

Reference numeral 22 designates a stopper comprising washers 23, 24 and a nut 25. The washer 23 and the nut 25 are firmly fastened to the bolt 18 so that they are not moved axially even if the bolt 18 is rotated. These stoppers 22 are provided between the head engaging portions 21 and the base portions 21'. Reference numeral 26 designates a washer provided below a bolt head.

Figure 8A:
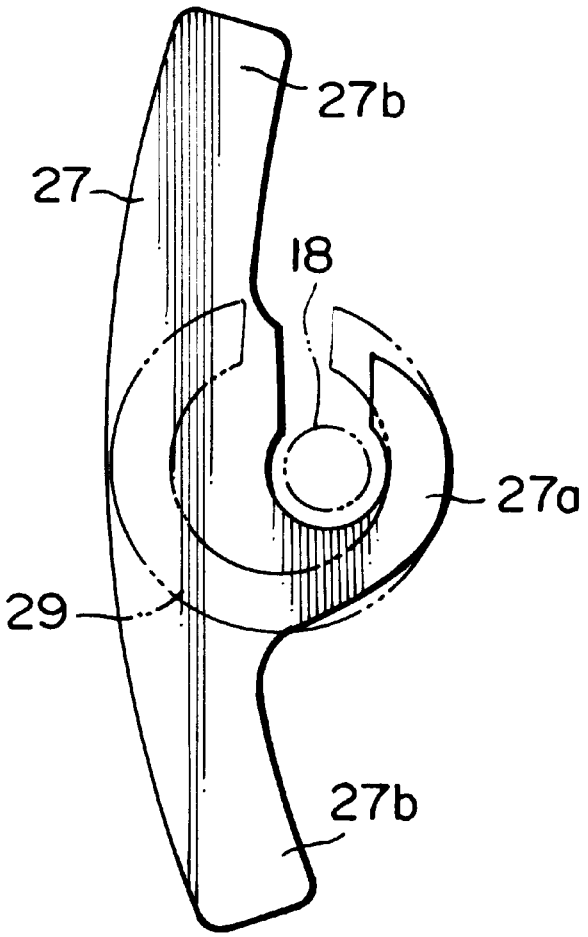
FIG. 8A is an enlarged plan view of a level adjusting spacer of the second embodiment according to the present invention.
Figure 8B:
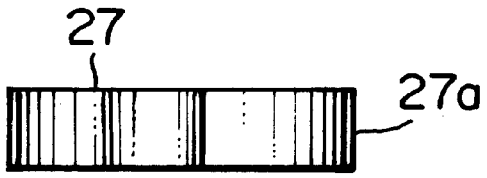
FIG. 8B is an enlarged front view of the level adjusting spacer of the second embodiment according to the present invention.

Reference numerals 27 designate level adjusting spacers inserted between the receiving seat 13 of the outer tube 1' and the cover receiving frame 20, and have a shape as shown in FIG. 8A. Spacers 27 are provided with hook-like portions 27*a* in engagement with bolts 18.

Figure 9A:
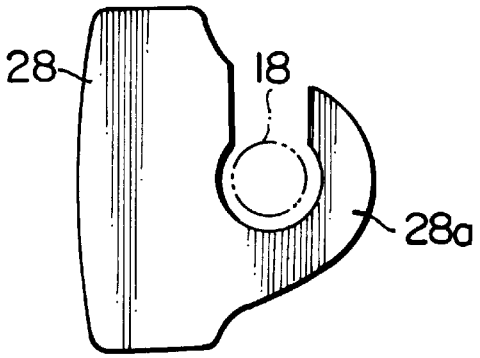
FIG. 9A is an enlarged plan view of a fine adjusting spacer of the second embodiment according to the present invention.
Figure 9B:
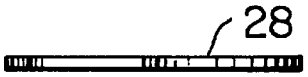
FIG. 9B is an enlarged front view of the fine adjusting spacer of the second embodiment according to the present invention.

Reference numeral 28 designates a fine adjusting spacer, which is made of a plate material as shown in FIG. 9A, and which resembles spacer 27 without arms 27*b*.

Figure 10A:
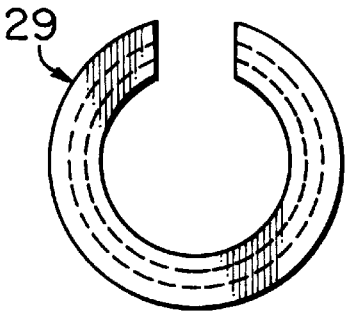
FIG. 10A is an enlarged plan view of a variable slope adjusting spacer of the second embodiment according to the present invention.
Figure 10C:
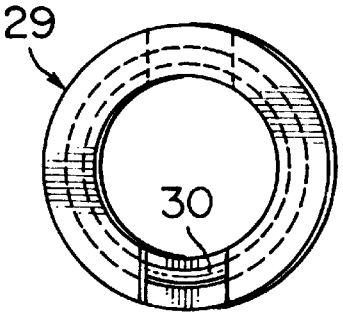
FIG. 10C is an enlarged plan view of the variable slope adjusting spacer of the second embodiment according to the present invention.
Figure 10B:
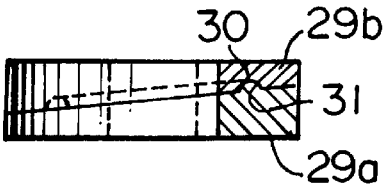
FIG. 10B is an enlarged front view of a variable slope adjusting spacer shown in FIG. 10A.
Figure 10D:
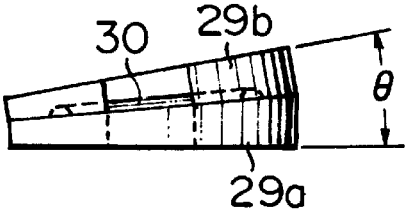
FIG. 10D is an enlarged front view of the variable slope adjusting spacer shown in FIG. 10C.

Reference numeral 29 designates a spacer having non-parallel top and bottom surfaces or in other words is a variable slope spacer provided below the lower base portion 21'. The variable slope spacer is composed of two C-shaped seat bodies 29*a*, 29*b* which taper as shown in FIGS. 10A and 10B. In addition, one variable slope spacer is provided with a convex portion 30 and the other is provided with a concave portion 31 fitted in the convex portion 30 so that the two are interlocked. An angle θ (a slope) formed between the upper surface and the lower surface may be changed as shown in FIG. 10D by rotating one of the spacers.

The assembling procedure in the present embodiment will be explained. First, the washers 26 and the bolts 18 with the stoppers 22 are brought into engagement with the head engaging portions 21 at three positions of the cover receiving frame 20 and the base portion 21'. After this, the cover receiving frame 20 is moved down into the outer tube 1', and the bolts 18 are threaded to the nuts 17. A suitable number of the level adjusting spacers 27, the fine adjusting spacers 28 and the variable slop spacers 29 are mounted according to the difference in level between the surface of the cover and the adjacent roadway.

Next, the procedure for the level adjusting operation and the operation for adjusting an angle of inclination of the manhole cover (not shown) will be described.

First, the procedure for the level adjusting operation will be described. In the case of raising the level, in FIG. 3 and FIG. 7, the bolts 18 are rotated to raise the upper surface of the cover receiving frame 20 to coincide with the road surface, and the aforementioned spacers are inserted into the gaps formed below the lower surface of the cover receiving frame 20. After completion of the level adjustment, the bolts 18 are fastened to the cover receiving frame 20.

On the other hand, in the case of lowering the level, the bolts 18 are rotated to raise the cover receiving frame 20. After this, any unnecessary spacers are removed. Then, the bolts are rotated to lower the cover receiving frame 20. When the cover receiving frame 20 coincides with the road surface, necessary spacers are inserted below the cover receiving frame 20, and the bolts 18 are fastened.

With the conventional prior art devices construction, it has been necessary to remove the adjacent asphalt road surface before the level adjusting operation. However, in the case of the present embodiment, such action is not necessary. The cover receiving frame 20 can be simply moved up and down by rotating the bolts 18. Work is completed by a simple operation in which a calking material is filled in a clearance formed between the cover receiving frame 20 and the asphalt road surface. Work can be finished in a short period of time, for example, scores of minutes or a few hours.

Next, the procedure for adjusting an angle of inclination will be explained. This procedure is similar to the level adjusting operation described above. The bolts 18 may be manipulated so that the upper surface of the cover receiving frame 20, that is the upper surface of the manhole cover, coincides with the inclination of the road surface.

In the illustrated embodiment, the bolts 18 and the nuts 17 are adjusted according to the desired inclination. The cover receiving frame 20 can be firmly locked to the inclined position by adding or removing variable slope spacers 29. The scales M are effective to facilitate these adjusting operations.

In this embodiment, nut 17 is inserted into the lateral hole 16 thereby avoiding troubles associated with forming internal threads in the outer tube 1'. Hence, a construction can be employed in which the bolt 18 is inclined. Also, in the case where a stainless steel material is used, the stainless steel material overcomes problems caused by the electric corrosion of threaded portions.

As described above, in the manhole cover receiving frame according to the present invention, the adjustment of the height and the adjustment of the angle of inclination can be accomplished simply from the top by rotating the bolts 18. Therefore, the time required to perform the level adjusting operation, and the time required for adjusting the angle of inclination can be shortened, and an exceptional manhole cover receiving frame can be provided.

THIRD EMBODIMENT

Figure 11:
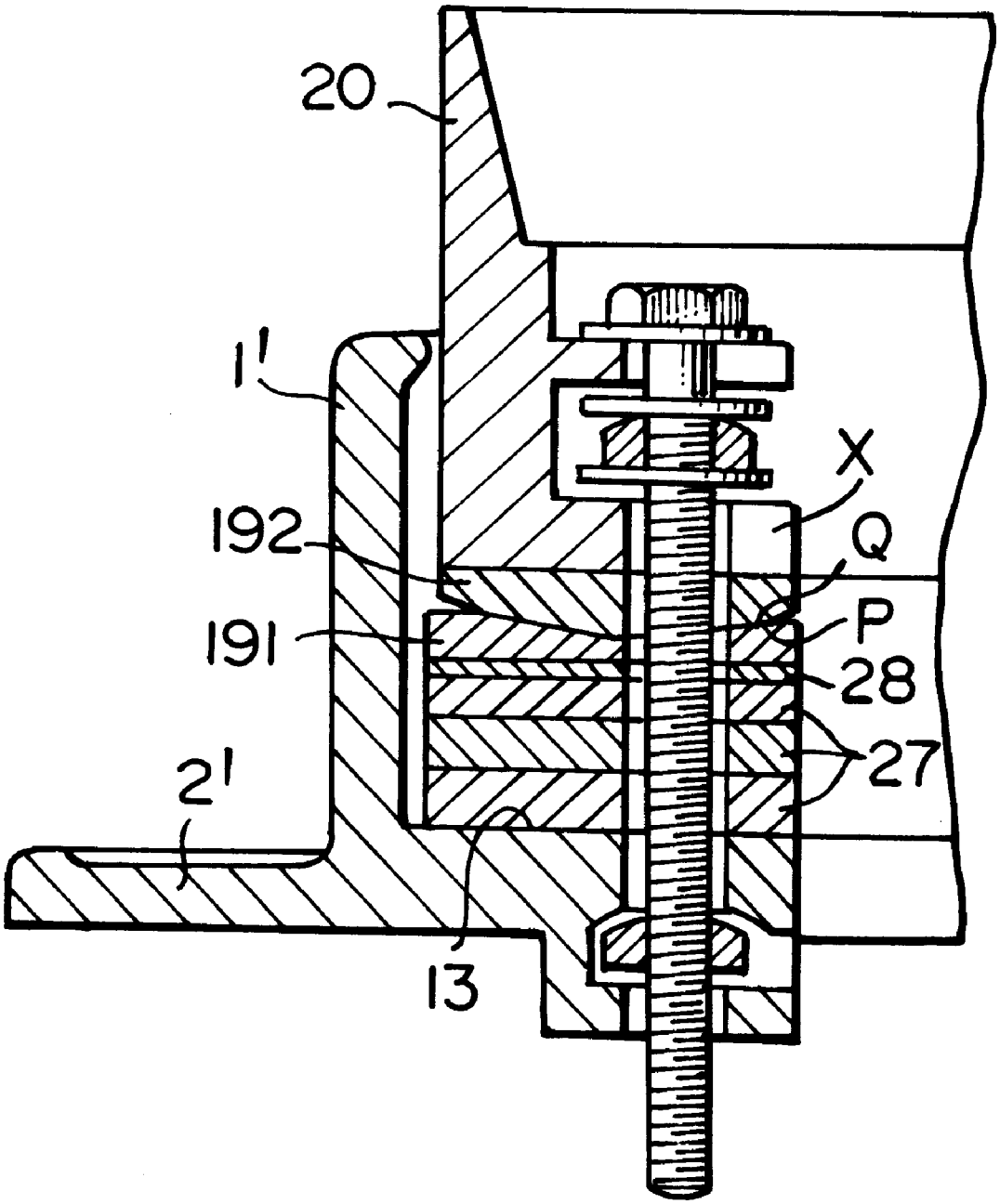
FIG. 11 is an enlarged sectional view of a third embodiment according to the present invention.

FIG. 11 shows a third embodiment of the present invention. When the cover receiving frame 20 is adjusted to the inclination of the road surface, the cover receiving frame 20 becomes firmly stabilized.

That is, variable slope spacers 191, 192, in contact with one another at concave surface P and convex surface Q, in addition to a suitable number of level adjusting spacers 27 and fine adjusting spacers 28 are provided between the outer tube 1' and the cover receiving frame 20 which are similar in construction to the second embodiment as shown in FIG. 2. Hence, stability is improved as compared with cases where the slope of the cover receiving frame 20 is adjusted merely by the level adjusting spacers 27 and the fine adjusting spacers 28.

What is claimed is:

1. A manhole cover frame comprising:

an outer tube to be mounted to a manhole;

a cover receiving frame positioned within said outer tube for movement in opposite directions relative thereto; and bolts connected to said outer tube and to said cover receiving frame for adjusting said cover receiving frame relative to said outer tube, each said bolt being axially and rotatably movable relative to said outer tube and being rotatably moveable relative to said cover receiving frame and being axially fixed relative thereto.

2. The manhole cover frame of claim 1, wherein each said bolt is threadingly engaged in a threaded hole in said outer tube.

3. The manhole cover frame of claim 1, wherein each said bolt is threadingly engaged in a nut that is mounted in said outer tube.

4. The manhole cover frame of claim 1, further comprising:

first and second variable slope spacers in contact with one another and located between said cover receiving frame and said outer tube.

5. The manhole cover frame of claim 4, wherein said first variable slope spacer has a bottom convex surface in contact with a concave surface of said second variable slope spacer.

6. The manhole cover frame of claim 1, wherein a scale for showing an adjustment height is provided on an outer surface of said cover receiving frame.

7. The manhole cover frame of claim 1, further comprising:

at least one spacer located between said cover receiving frame and said outer tube.

8. The manhole cover frame of claim 1, further comprising:

first and second variable slope spacers;

wherein said first variable slope spacer has a top surface, a bottom surface which is not parallel to said top surface, and a concave portion formed in said bottom surface;

wherein said second variable slope spacer has a top surface, a bottom surface which is not parallel to said top surface, and a convex portion formed in said top surface; and wherein said first variable slope spacer is located above said second variable slope spacer such that said convex portion is located in said concave portion.

* * * * *